US007172473B2

(12) United States Patent
Mehnert

(10) Patent No.: US 7,172,473 B2
(45) Date of Patent: Feb. 6, 2007

(54) RUDDER INDICATOR

(76) Inventor: Timothy W. Mehnert, 10644 Knights Way, North Royalton, OH (US) 44133

( * ) Notice: Subject to any disclaimer, the term of this patent is extended or adjusted under 35 U.S.C. 154(b) by 0 days.

(21) Appl. No.: 10/802,177

(22) Filed: Mar. 17, 2004

(65) Prior Publication Data

US 2005/0204986 A1 Sep. 22, 2005

(51) Int. Cl.
*B63H 25/36* (2006.01)
*B63H 25/10* (2006.01)

(52) U.S. Cl. ..... 440/2; 114/144 R; 114/162; 340/987

(58) Field of Classification Search ..... 114/144 R, 114/162, 144 RE, 144 A, 144 E; 116/31, 116/303; 701/21; 340/987; 440/2
See application file for complete search history.

(56) References Cited

U.S. PATENT DOCUMENTS

| | | | | | |
|---|---|---|---|---|---|
| 1,377,427 | A | * | 5/1921 | O'Neil | 464/117 |
| 1,589,673 | A | * | 6/1926 | Winter | 318/675 |
| 2,136,213 | A | * | 11/1938 | Hodgman | 74/395 |
| 2,925,060 | A | | 2/1960 | Weeks | |
| 3,331,350 | A | * | 7/1967 | Norton | 116/31 |
| 3,695,205 | A | | 10/1972 | Thomas | |
| 3,723,011 | A | | 3/1973 | Flory et al. | |
| 3,793,731 | A | * | 2/1974 | Hyyppa et al. | 33/1 PT |
| 3,939,795 | A | * | 2/1976 | Rocka | 440/78 |
| 4,334,491 | A | * | 6/1982 | Kulischenko | 116/31 |
| 4,634,978 | A | | 1/1987 | Watanabe | |
| 4,739,236 | A | | 4/1988 | Burkenpas | |
| 4,912,465 | A | * | 3/1990 | Greer | 340/987 |
| 6,003,887 | A | | 12/1999 | Howard | |
| 6,201,483 | B1 | * | 3/2001 | Ziehm | 114/144 R |
| 6,549,831 | B2 | | 4/2003 | Thompson | |

FOREIGN PATENT DOCUMENTS

| | | | |
|---|---|---|---|
| ES | 2012583 | A * | 4/1990 |
| GB | 0023790 | A * | 0/1910 |
| GB | 2231545 | A * | 11/1990 |
| JP | 55160696 | A * | 12/1980 |
| JP | 56025096 | A * | 3/1981 |
| JP | 56075298 | A * | 6/1981 |
| JP | 56116598 | A * | 9/1981 |
| JP | 59045295 | A * | 3/1984 |
| JP | 62251297 | A * | 11/1987 |
| JP | 2001165607 | A * | 6/2001 |
| JP | 2003344009 | A * | 12/2003 |

* cited by examiner

*Primary Examiner*—Ajay Vasudeva
(74) *Attorney, Agent, or Firm*—Pearne & Gordon LLP

(57) ABSTRACT

A rudder position indicator apparatus includes a cam mounted on a steering linkage of a watercraft. The steering linkage is or an outdrive. When the rudder or an outdrive is in a straight position, the cam activates a micro switch, which in turn, supplies a ground for an indicator light to illuminate. The indicator light can be located on a dash of the watercraft.

17 Claims, 3 Drawing Sheets

FIG. 1
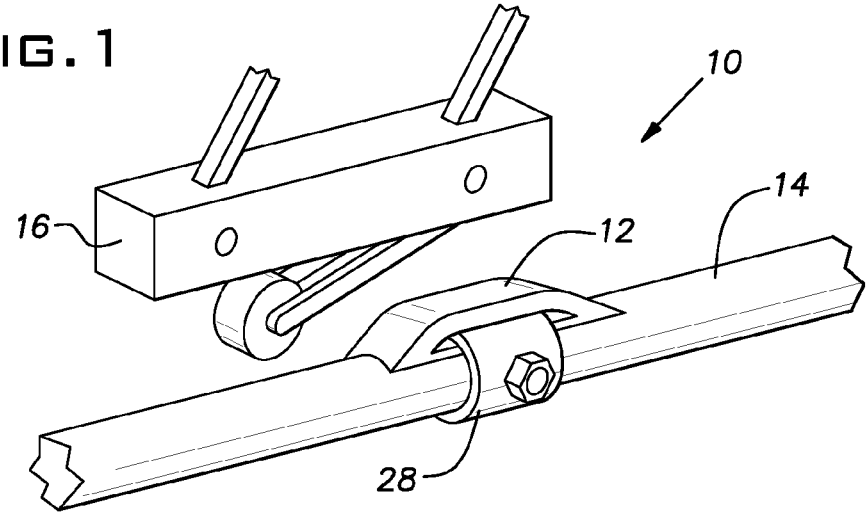
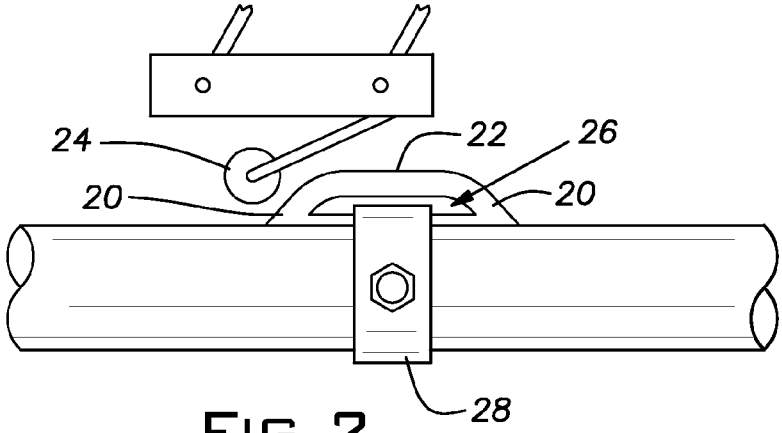
FIG. 2
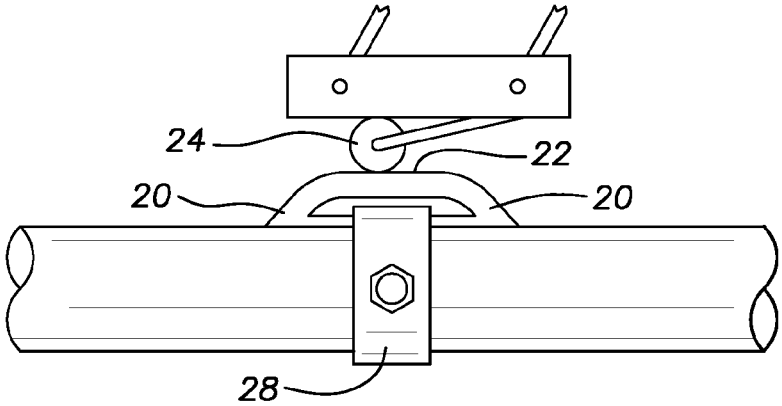
FIG. 3

RUDDER INDICATOR

FIELD OF THE INVENTION

The invention relates to indicator systems for marine vehicles and in particular, to an indicator for indicating the position of an angularly movable member such as the rudder of a boat.

BACKGROUND OF THE INVENTION

Various types of rudder angle indicator systems currently exist. In one type of rudder angle indicator system, a conventional synchro transmitter is coupled to a rudder to provide a synchro signal output in accordance with rudder angle. A conventional synchro receiver, coupled to a rudder angle indicator, positions the indicator to an angle in accordance with the synchro signal thereby displaying the rudder angle. Plural synchro receivers may be required if multiple indicator units are utilized. Typical synchro transmitter and receiver devices tend to be expensive adversely affecting the cost competitiveness of a rudder angle indication system in which they are utilized.

Another approach to rudder angle indication utilizes a potentiometer sensor coupled to the rudder to provide a voltage proportional to rudder angle. The rudder angle indicating voltage is applied to a plurality of meter movement indicators with appropriate rudder angle indication scales. Such an analog system tends to be inaccurate and unreliable and requires amplifiers in accordance with the number of such indicators utilized on the ship. Significantly, the meter movement approach is inappropriate for positioning the large three-faced rudder angle indicator without undesirable design complexity and expense. Thus, it is appreciated that this analog approach is primarily limited to providing variously positioned small meter movement indicators about the ship for displaying rudder angle.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a rudder position indicator apparatus is provided. The rudder position indicator apparatus includes a cam coupled to a steering linkage bar of a watercraft; and a switch coupled to a fixed portion of the watercraft. The cam is operable to activate the switch when a rudder of the watercraft is in a centered position.

In accordance with another aspect of the present invention, a rudder position indicator apparatus includes a cam secured to a steering linkage bar of a watercraft; means for contacting the cam when a rudder of the watercraft is centered; and means for indicating when the rudder of the watercraft is centered.

To the accomplishment of the foregoing and related ends, the invention then, comprises the features hereinafter fully described and particularly pointed out in the claims. The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE DRAWINGS

FIG. 1 illustrates a perspective view of a rudder angle indicator system in accordance with an aspect of the present invention.

FIG. 2 illustrates a front view of a rudder angle indicator system when the rudder is off-center in accordance with an aspect of the present invention.

FIG. 3 illustrates a front view of a rudder angle indicator system when the rudder is centered in accordance with an aspect of the present invention.

DETAILED DESCRIPTION OF THE INVENTION

Figure 4:
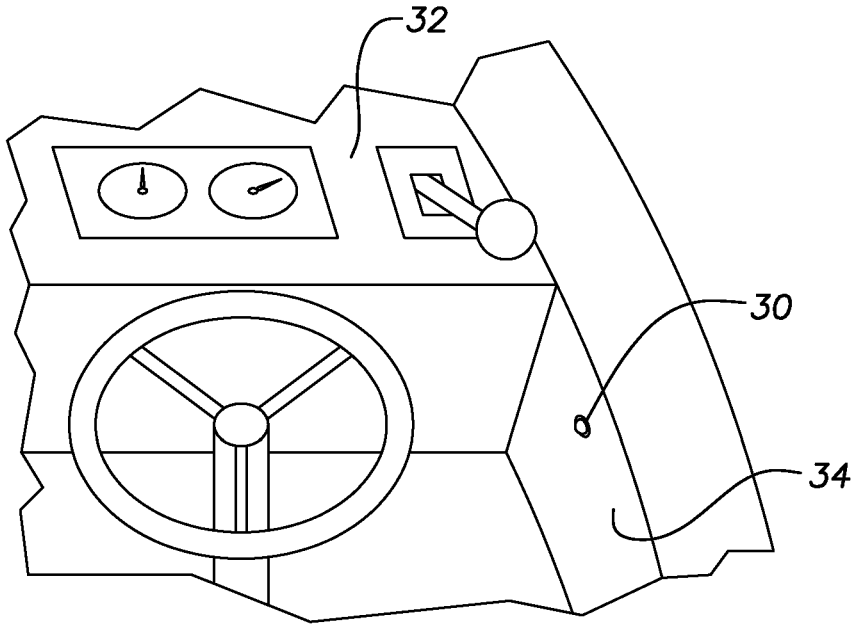
FIG. 4 illustrates a rudder angle indicator light provided on a dash of a watercraft in accordance with an aspect of the present invention.

The present invention relates to a rudder angle indicator system and will now be described with reference to the drawings, wherein like reference numerals are used to refer to like elements throughout. It is to be appreciated that the various drawings are not drawn to scale from one figure to another nor inside a given figure, and in particular that the size of the components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details. In other instances, well-known structures and devices are shown in block form in order to facilitate describing the present invention.

Referring initially to FIG. 1, a rudder position indicator apparatus 10 is illustrated in accordance with an aspect of the present invention. The rudder position indicator apparatus 10 includes a cam 12 coupled to a steering linkage bar 14 of a watercraft. The steering linkage bar 14 is connected to at least one rudder or outdrive unit (not shown) of the watercraft. The rudder is a conventional rudder as known to those skilled in the art of watercrafts, and comprises a vertical blade that is pivotable about a vertical axis thereof to facilitate steering of the watercraft. The steering linkage bar 14 is controlled by mechanical components such as cables and/or hydraulic actuators which transmit steering commands from a steering wheel or helm to move the steering linkage bar 14 left or right along its longitudinal axis, thereby moving the rudder(s) left or right.

Figure 5:
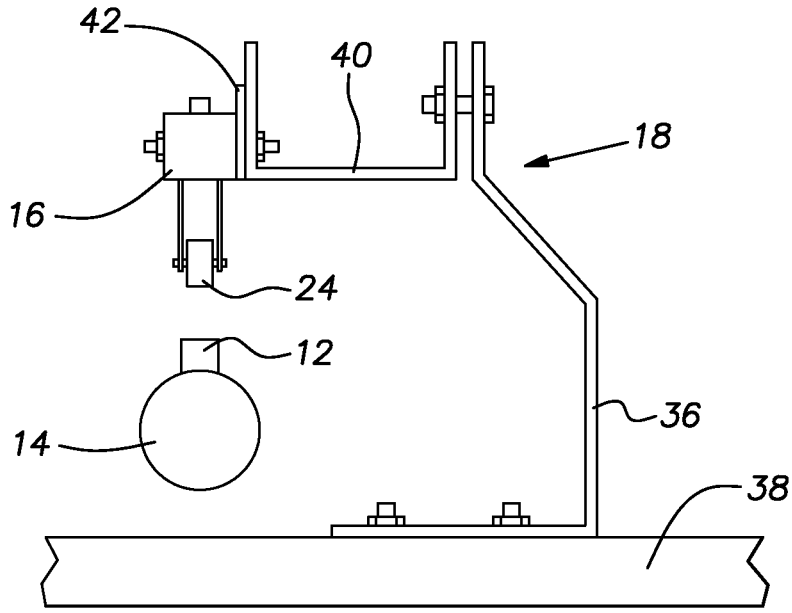
FIG. 5 illustrates a side view of a rudder angle indicator system in accordance with an aspect of the present invention.
Figure 6:
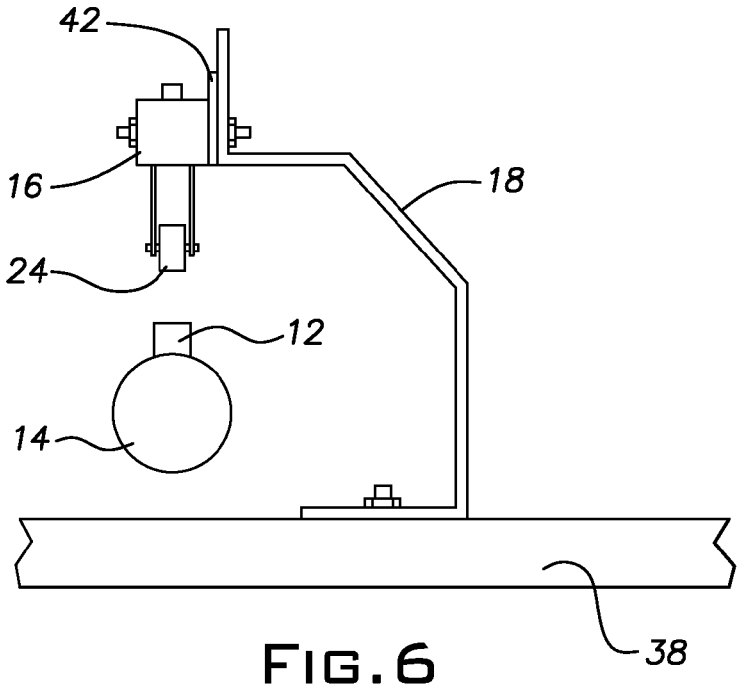
FIG. 6 illustrates another bracket configuration for a rudder angle indicator system in accordance with an aspect of the present invention.
Figure 7:
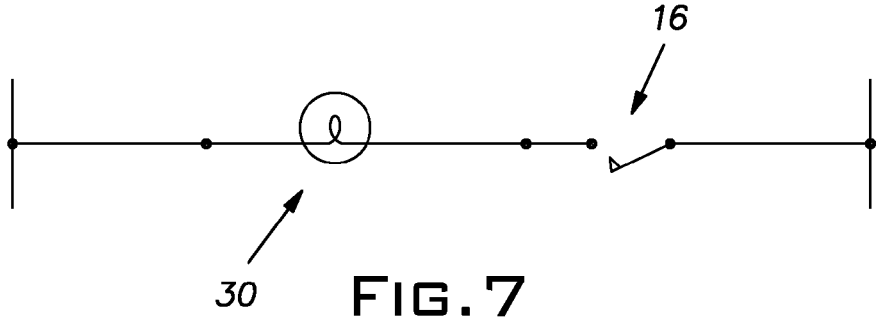
FIG. 7 illustrates a circuit diagram of a switch electrically connected to an indicator in accordance with an aspect of the present invention.

A switch 16 is secured to a fixed portion of the watercraft, such as an inner surface of a hull or transform of the watercraft, via one or more brackets 18 (FIGS. 5 and 6). The number and configuration of bracket(s) 18 can vary depending upon how a user desires to position the switch 16 on the watercraft. The switch 16 is position such that it is contacted and thus, activated by the cam 12 when the rudder(s) is in a centered position. The switch 16 is preferably a micro switch and is in electrical connection with an indicator light that can be located at an easily visible portion in the watercraft (FIG. 7.).

Turning now to FIGS. 2 and 3, the rudder position indicator apparatus 10 is depicted when the rudder(s) is in a non-centered position and a centered position, respectively. As illustrated in FIGS. 2 and 3, the cam 12 can have a substantially D-shaped cross section. The cam 12 can include sloped side walls 20 and a substantially flat top potion 22 such that an actuator 24 of the switch 16 can easily travel up the sloped side walls 20 and rest on the top portion 22 when the rudder(s) is centered. The cam 12 can also include an aperture 26 in a bottom portion of the cam 12 to facilitate securing the cam 12 to the steering linkage bar 14. For example, a clamp hose 28 can be employed to couple the cam 12 to the steering linkage bar 14. However it is to be appreciated that the cam 12 can be coupled to the steering linkage bar 14 in any suitable manner.

During operation of the watercraft, when the steering wheel is turned to move the rudder(s) away from the centered position to either the left or the right, the steering linkage bar 14 is moved such that the switch 16 is out of alignment with the cam 12, thereby leaving the switch 16 open, as shown in FIG. 2. When the steering wheel of the watercraft is turned to move the rudder(s) back to the centered position, the steering linkage bar 14 is moved such that the switch 16 comes into physical contact with the cam 12, thereby activating the switch 16. The switch 16 then sends a signal to indicate that the rudder(s) is centered. As illustrated in FIG. 4, the signal can be a light 30 located on a dashboard 32 or on a side panel 34 of the watercraft. However, it is to be appreciated that the signal can be of any type and can be located in any suitable location. For example, the signal can be alternatively, or additionally, transmitted to a remote handheld terminal to indicate when the rudder(s) is centered.

Turning now to FIG. 5, a side view of the rudder position indicator apparatus 10 is illustrated in accordance with an aspect of the present invention. In the shown example, the apparatus 10 includes a first bracket 36 secured to the fixed portion 38 of the watercraft via a screw or any other suitable fastener. The switch 16 is secured to a second bracket 40 via a bolt or any other suitable fastener. An insulator member 42 can be provided between the switch 16 and the second bracket 40 to mitigate excess vibration. At least one, preferably both, of the first and second brackets 38, 40 include corresponding slotted apertures such that the position of the second bracket 40 and thus, the switch 16, can be adjusted with respect to the position of the first bracket 38. The first and second brackets 38, 40 can be coupled together via a bolt and nut combination. The switch 16 is positioned in vertical alignment with the cam 12 so that the cam 12 can properly activate the switch 16 when the cam 12 and switch 16 come into contact with one another.

It is to be appreciated that any suitable bracket configuration can be employed and is contemplated as falling within the scope of the present invention. For example, FIG. 6 illustrates another example of a bracket configuration 18 that can be employed with the present invention. The rudder position indicator apparatus described herein has many advantages over conventional rudder indicators. Due to the simplicity of the present invention, the number of parts and the cost associated with the apparatus is significantly lower than conventional apparatuses.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A rudder position indicator apparatus comprising:

a cam coupled to a steering linkage bar of a watercraft, the steering linkage bar having a longitudinal axis;

a rudder mechanism coupled to the steering linkage bar of the watercraft, the rudder mechanism having at least one vertical rudder, wherein the at least one vertical rudder is pivotable about a vertical axis in response to a movement of the steering linkage bar along the longitudinal axis;

a steering mechanism coupled to the rudder mechanism via the steering linkage bar such that movement of the steering mechanism effects movement of the vertical rudder;

a switch coupled to a fixed portion of the watercraft, wherein the cam activates the switch when the vertical rudder of the watercraft is in a centered position; and an indicator in electrical communication with the switch to indicate to an operator of the watercraft when the rudder of the watercraft is in the centered position.

2. The rudder position indicator apparatus of claim 1, wherein the cam is coupled to the steering linkage bar via a clamp hose.

3. The rudder position indicator apparatus of claim 1, wherein the switch is coupled to a fixed portion of the watercraft via one or more brackets.

4. The rudder position indicator apparatus of claim 3, further comprising at least one insulator member between the switch and at least one of one or more brackets to mitigate excess vibration in the switch.

5. The rudder position indicator apparatus of claim 1, wherein the switch is a micro switch.

6. The rudder position indicator apparatus of claim 1, wherein the switch is electrically connected to the indicator, the indicator being a light located on a dash of the watercraft.

7. The rudder position indicator apparatus of claim 1, further comprising a plurality of brackets to secure the switch to the fixed portion of the watercraft, wherein the brackets are adjustable to adjust a position of the switch.

8. The rudder position indicator of claim 7, wherein first and second brackets are provided, the second bracket being coupled to the switch, wherein at least one of the first and second brackets includes a slotted aperture such that a position of the second bracket and thus, the switch, can be adjusted with respect to the first bracket.

9. The rudder position indicator apparatus of claim 1, wherein the cam includes sloped sidewalls and a substantially flat top portion.

10. The rudder position indicator apparatus of claim 1, wherein the cam includes two sidewalls joined by a top portion, wherein at least one of the sidewalls is substantially sloped.

11. The rudder position indicator apparatus of claim 1, wherein the cam has a substantially D-shaped cross-section.

12. The rudder position indicator apparatus of claim 1, wherein the steering mechanism is a steering wheel.

13. The rudder position indicator apparatus of claim 1, wherein the steering linkage bar is controlled by mechanical components including at least one of cables and hydraulic actuators to transmit steering commands from the steering mechanism to the steering linkage bar.

14. A rudder position indicator apparatus comprising:

a steering linkage bar of a watercraft, the steering linkage bar having a longitudinal axis;

a cam secured to the steering linkage bar, the cam movable along the longitudinal axis of the steering linkage bar;

a manually operable rudder mechanism having a rudder coupled to the steering linkage bar, wherein the rudder is movable in response to a movement of the steering linkage bar along the longitudinal axis, and wherein the steering linkage bar is controlled via a steering mechanism; and means for contacting the cam, said means for contacting being activated by the cam when the rudder of the watercraft is moved to a centered position; and means for indicating, said means for indicating being activated by said means for contacting when the rudder of the watercraft is moved to the centered position.

15. The rudder position indicator apparatus of claim 14, wherein the means for indicating includes a light located on a dash of the watercraft.

16. The rudder position indicator apparatus of claim 14, wherein the steering mechanism is a steering wheel.

17. The rudder position indicator apparatus of claim 14, wherein the rudder is a vertically hinged plate mounted at a stem of the watercraft.

* * * * *

UNITED STATES PATENT AND TRADEMARK OFFICE

CERTIFICATE OF CORRECTION

PATENT NO. : 7,172,473 B2
APPLICATION NO. : 10/802177
DATED : February 6, 2007
INVENTOR(S) : Timothy W. Mehnert It is certified that error appears in the above-identified patent and that said Letters Patent is hereby corrected as shown below:

On the cover page, [56] Foreign Patent Documents, reference GB 0223790 A, please delete the date "0/1910" and insert the date --08/1910--

On title page [57]
In the Abstract, line three, after linkage is and before or an outdrive, please insert --coupled to a rudder--

Signed and Sealed this

First Day of May, 2007

JON W. DUDAS
*Director of the United States Patent and Trademark Office*